US008387704B2

(12) United States Patent
Rodrigues

(10) Patent No.: US 8,387,704 B2
(45) Date of Patent: Mar. 5, 2013

(54) SYSTEM AND METHOD FOR SIMULTANEOUS SEA DRILLING OPERATIONS

(75) Inventor: Roberto Rodrigues, Rio de Janeiro (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 203 days.

(21) Appl. No.: 12/562,389

(22) Filed: Sep. 18, 2009

(65) Prior Publication Data

US 2010/0071906 A1 Mar. 25, 2010

(30) Foreign Application Priority Data

Sep. 19, 2008 (BR) ..... 0803619

(51) Int. Cl.
*E21B 19/00* (2006.01)

(52) U.S. Cl. ..... 166/352; 166/358; 166/378; 166/77.51; 166/85.1; 405/201

(58) Field of Classification Search ..... 166/358, 166/339, 344, 351, 352, 367, 378, 381, 385, 166/77.51, 85.1, 85.5; 175/5–10; 405/195, 405/201

See application file for complete search history.

(56) References Cited

U.S. PATENT DOCUMENTS 3,718,266 A * 2/1973 Donnally ..... 414/22.71
3,895,677 A * 7/1975 Bokenkamp ..... 166/359
3,981,369 A * 9/1976 Bokenkamp ..... 175/5
4,007,782 A * 2/1977 Nybo et al. ..... 166/79.1
4,063,650 A * 12/1977 Homer ..... 105/29.1
4,081,163 A * 3/1978 Guinn et al. ..... 248/637
4,108,318 A * 8/1978 Rode et al. ..... 414/22.51
4,230,190 A * 10/1980 Guinn et al. ..... 175/5
4,367,796 A * 1/1983 Bolding ..... 166/341
4,574,241 A * 3/1986 Stelly ..... 324/326
4,716,972 A * 1/1988 Makinen et al. ..... 175/8
4,819,730 A * 4/1989 Williford et al. ..... 166/355
4,899,682 A * 2/1990 Pouget et al. ..... 114/264
5,647,443 A * 7/1997 Broeder ..... 175/5
6,047,781 A * 4/2000 Scott et al. ..... 175/5
6,056,071 A * 5/2000 Scott et al. ..... 175/5
6,068,069 A * 5/2000 Scott et al. ..... 175/5
6,085,851 A * 7/2000 Scott et al. ..... 175/7
6,161,358 A * 12/2000 Mochizuki et al. ..... 52/651.05
6,217,258 B1 * 4/2001 Yamamoto et al. ..... 405/201
6,321,675 B1 * 11/2001 Dybdahl et al. ..... 114/264
6,443,240 B1 * 9/2002 Scott ..... 175/7
6,766,860 B2 * 7/2004 Archibald et al. ..... 166/341
6,926,488 B1 * 8/2005 Bolding et al. ..... 414/22.62
6,955,223 B2 * 10/2005 Orr et al. ..... 166/378
7,021,402 B2 * 4/2006 Beato et al. ..... 175/7
7,451,821 B2 * 11/2008 Rashid et al. ..... 166/358
7,628,224 B2 * 12/2009 D'Souza et al. ..... 175/5
7,628,225 B2 * 12/2009 Petersson et al. ..... 175/5
2007/0251725 A1 * 11/2007 Banks ..... 175/5
2008/0000685 A1 * 1/2008 Humphreys ..... 175/5
2008/0314598 A1 12/2008 Rodrigues et al.
2009/0223660 A1 * 9/2009 Petersson ..... 166/85.4
2010/0108322 A1 * 5/2010 Eilertsen ..... 166/352

* cited by examiner

*Primary Examiner* — Matthew Buck
(74) *Attorney, Agent, or Firm* — Sughrue Mion, PLLC

(57) ABSTRACT

A system and method for carrying out simultaneous operations of assembling, dismantling, and maintaining equipment installed by an oil rig, using the tools, systems, and the areas available on the rig itself. The system includes two parallel and separated sustaining beams and two mobile bases supported on the beams to carry out the simultaneous operations. This system allows a method for simultaneously assembling two items of subsea equipment which are to be installed to be performed. Also, this system allows a method for simultaneously replacing and assembling subsea equipment to be performed. Additionally, the equipment can be lowered or recovered using either a derrick and pipe string or a winch and steel cable.

12 Claims, 11 Drawing Sheets

SYSTEM AND METHOD FOR SIMULTANEOUS SEA DRILLING OPERATIONS

CROSS-REFERENCE TO RELATED APPLICATIONS

This application claims priority under 35 U.S.C. 119 (a) from Brazilian Patent Application PI 0803619-5, filed on Sep. 19, 2008, in the Brazilian Intellectual Property Office, the disclosure of which is incorporated by reference in its entirety.

BACKGROUND OF THE INVENTION

1. Field of the Invention

Apparatuses and methods consistent with the present invention relate to systems and methods for the simultaneous execution of operations. In particular, the present invention relates to the simultaneous operations of assembling, dismantling, and maintaining equipment being installed by an offshore oil rig.

2. Description of the Related Art

Oil production at sea requires the use of drilling rigs and completion rigs. These drilling rigs and the completion rigs are used during many different phases in the operation of an offshore oil rig. These phases range from the drilling of wells to the lowering of subsea equipment, such as wet Christmas trees, pumping modules, and other devices.

The operation of these rigs employs a large quantity of manpower and has high costs. These rigs have systems for lifting loads, handling and moving loads, rotating loads, generating and transmitting energy, circulating fluids, ensuring well safety, and monitoring.

The systems for lifting loads, moving loads, and rotating loads are the principal systems used for assembling, dismantling, and maintaining equipment, tools, and accessories and for lowering equipment to or recovering it from the well or the sea bottom. These equipment, tools, and accessories may be used, for example, for the connection, disconnection, and assembly of tubes used to pump oil out of the well.

A system to lift and lower loads comprises a suspension tower, or derrick, and tools for suspending the load. A load handling and movement system (drawworks) comprises a group of fixed and mobile pulleys, and tools for moving loads; and a system for rotating loads comprises a rotary table, located below the suspension tower, and other tools such as transmission components (the Kelly) and the drive swivel.

Rigs also usually have an area open to the sea, similar to a swimming pool, known as the "moon pool", just below the rotary table, where large-scale equipment is assembled and dismantled.

Operations such as assembling, dismantling, and maintaining large equipment, and the lowering of tubes and installation of equipment are carried out using the derrick and the rotary table. Since there is normally only one derrick per oil rig, the above operations have to be carried out sequentially, and simultaneous execution of two or more operations is not possible. This increases the time and cost of drilling operations, as well as leaving part of the manpower unoccupied.

U.S. Pat. No. 4,819,730 describes one attempt at solving the above problem. Specifically, U.S. Pat. No. 4,819,730 uses a rig with two towers to make simultaneous operations possible. However, application of this invention is limited to new rigs, built with two towers, which have a higher construction cost. In rigs having only one derrick, the limitations of carrying out operations sequentially remain.

SUMMARY OF THE INVENTION

Thus, it is an object of the invention, as embodied in the non-limiting and exemplary embodiments disclosed herein, to overcome and avoid the above problems, and to allow simultaneous execution of operations even if only one tower is used. Also, a person of ordinary skill in the art will readily recognize that the invention disclosed below can also provide benefits even if an oil rig has two or more towers, and the invention is not limited to when an oil rig only has one tower.

Exemplary embodiments of the present invention address at least the above problems and/or disadvantages and other disadvantages not described above. Also, the present invention is not required to overcome the disadvantages described above, and an exemplary embodiment of the present invention may not overcome any or all of the problems described above.

According to an aspect of the present invention, there is provided a system for simultaneous execution of operations by a drilling rig or completion rig including at least two sustaining beams which are substantially parallel to and separated from each other, are substantially parallel to the sea surface, and extend horizontally over an entire length of a moon pool; a first mobile base which is supported on the at least two sustaining beams and can move horizontally over the at least two sustaining beams with the use of sliding components; and a second mobile base which is supported on the at least two sustaining beams and can move horizontally on the at least two sustaining beams with the use of sliding components.

The above system provides significant advantages in relation to the state of the art by making the following possible:

i. Substantial reduction of rig time and cost needed for assembling, dismantling, and maintaining equipment installed by a drilling rig, resulting in a shorter amount of time necessary for operating the rig;

ii. Increase in the reliability of the operation of the rig by making it possible to carry out operations at different positions;

iii. Increase in the flexibility of the rig's processes and operations;

iv. Increase in the efficiency of the rig's operations, including reducing idle manpower time; and v. Reduction of the time necessary for lowering and recovering equipment that can be moved by a winch and steel cable in the open sea.

BRIEF DESCRIPTION OF THE DRAWINGS

These and/or other aspects of the present invention will become apparent and more readily appreciated from the following description of the exemplary embodiments, taken in conjunction with the accompanying drawings, in which.

DETAILED DESCRIPTION OF THE INVENTION

Figure 1:
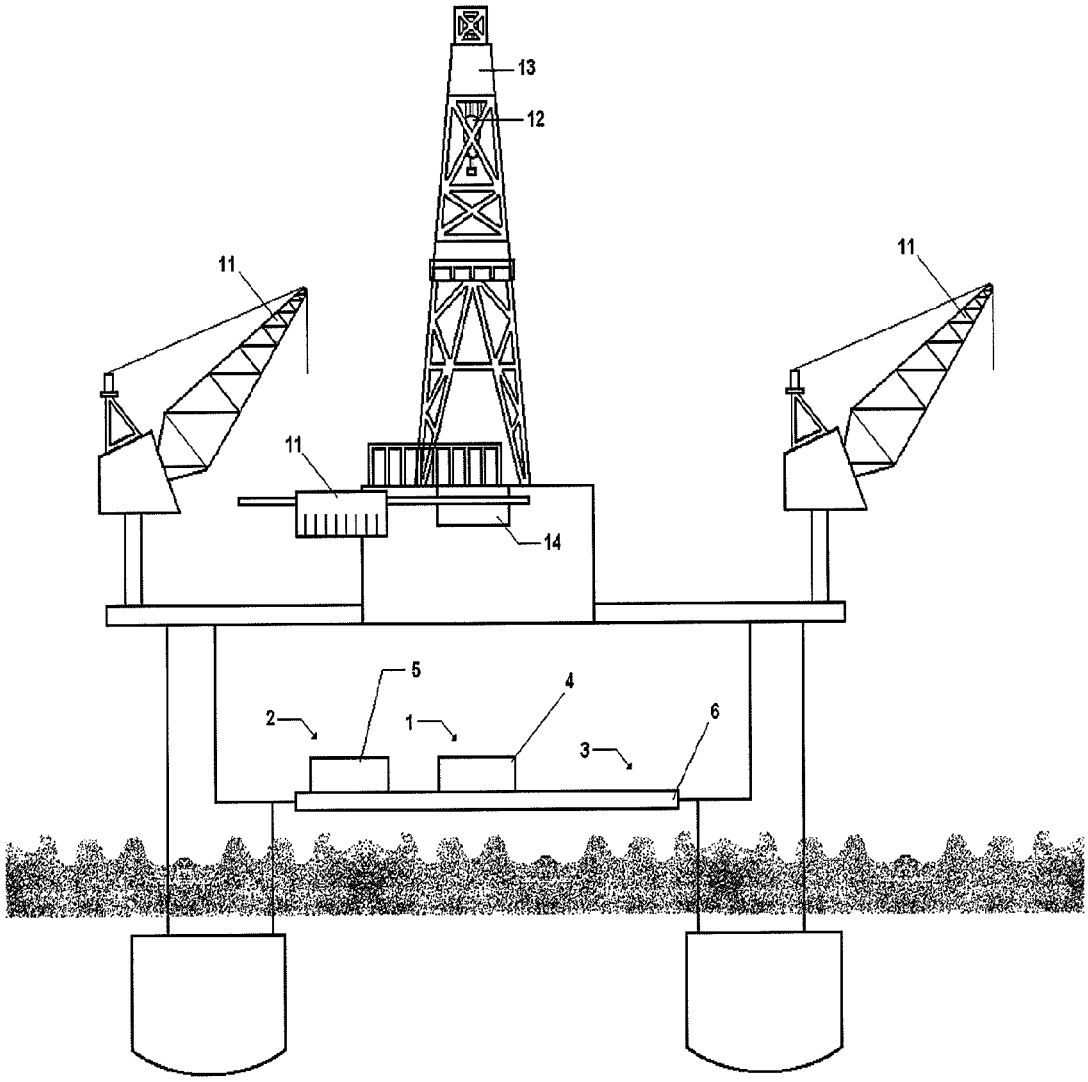
FIG. 1 schematically illustrates an exemplary embodiment of a rig with mobile bases 4 and 5 which are supported on sustaining beams 6.

In the following description, the same drawing reference numerals are used for the same elements in different drawings. The matters defined in the description, such as detailed construction and element descriptions, are provided to assist in a comprehensive understanding of the invention. Also, well-known functions or constructions are not described in detail since they would obscure the invention with unnecessary detail.

FIG. 1 presents a schematic illustration of an exemplary embodiment of a system for simultaneously executing operations with an oil rig. The system comprises:

i. At least two separated sustaining beams 6 which extend horizontally over the whole length of the moon pool and are substantially parallel to one another. The at least two sustaining beams 6 are also substantially parallel to the surface of the sea;

ii. A first mobile base 4 which is supported on the at least two sustaining beams 6. The first mobile base 4 is able to move horizontally on the at least two sustaining beams 6 with the use of sliding devices (not shown); and iii. A second mobile base 5 which is supported on the at least two sustaining beams 6. The second mobile base is able to move horizontally over the at least two sustaining beams 6 with the use of sliding devices (not shown).

The operations carried out on the mobile bases 4 and 5 can be operations of assembling, dismantling, and maintaining subsea equipment which are usually installed by an oil rig on the seabed or inside wells. This equipment may be, for example, Christmas trees, pumping modules, or other equipment.

The mobile bases 4 and 5 are moved laterally using devices (not shown) that slide over the sustaining beams 6 such as, for example, roller bearings.

A drilling rig using the system described above is able to perform:

i. Simultaneous assembly of two items of subsea equipment which are to be installed; and ii. Simultaneous replacement and assembly of subsea equipment.

Figure 2:
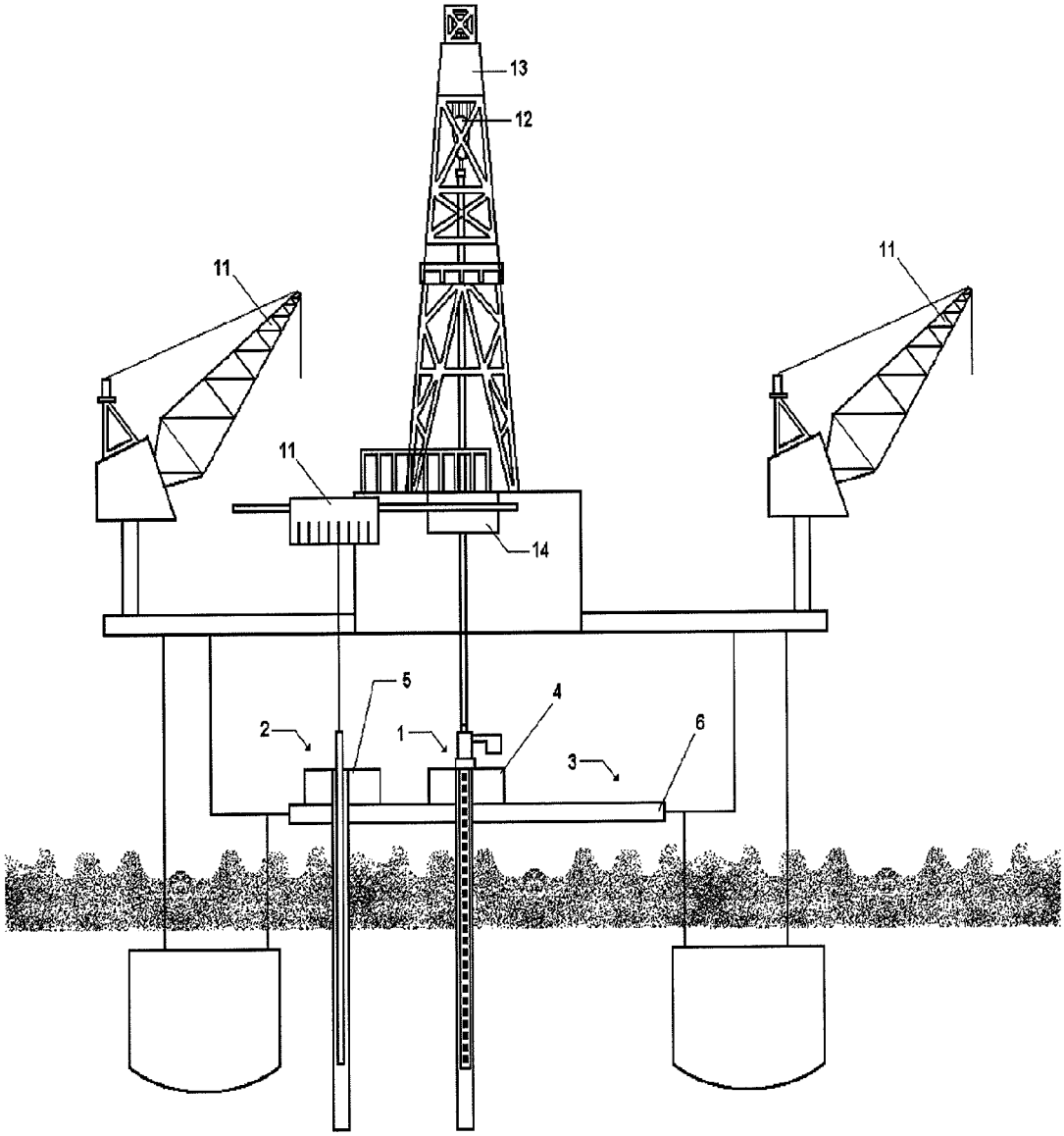
FIG. 2 illustrates the rig of FIG. 1 wherein equipment to be installed by the rig is simultaneously assembled on the moving bases 4 and 5.
Figure 3:
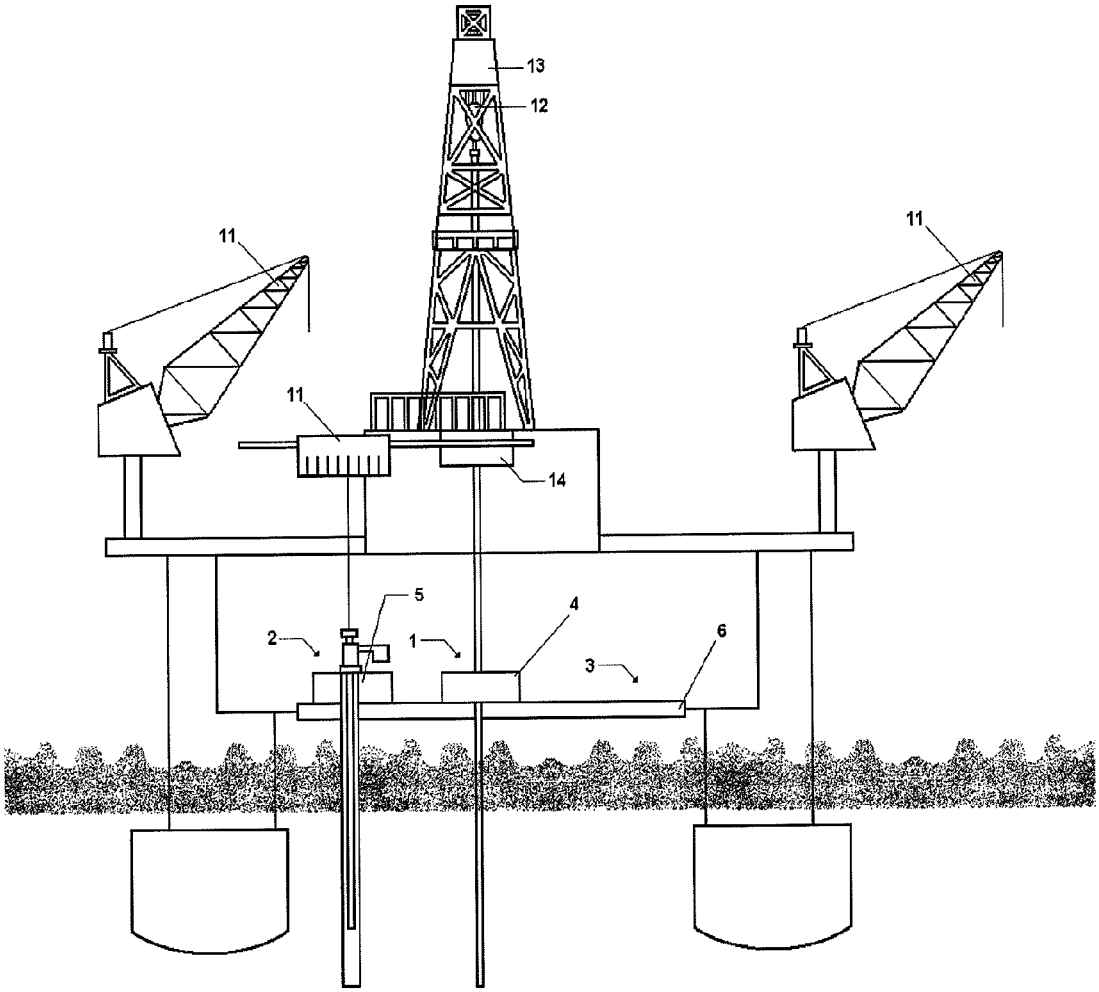
FIG. 3 illustrates the rig of FIG. 1 wherein the rig is installing the equipment assembled on the first mobile base 4 on the seabed.
Figure 4:
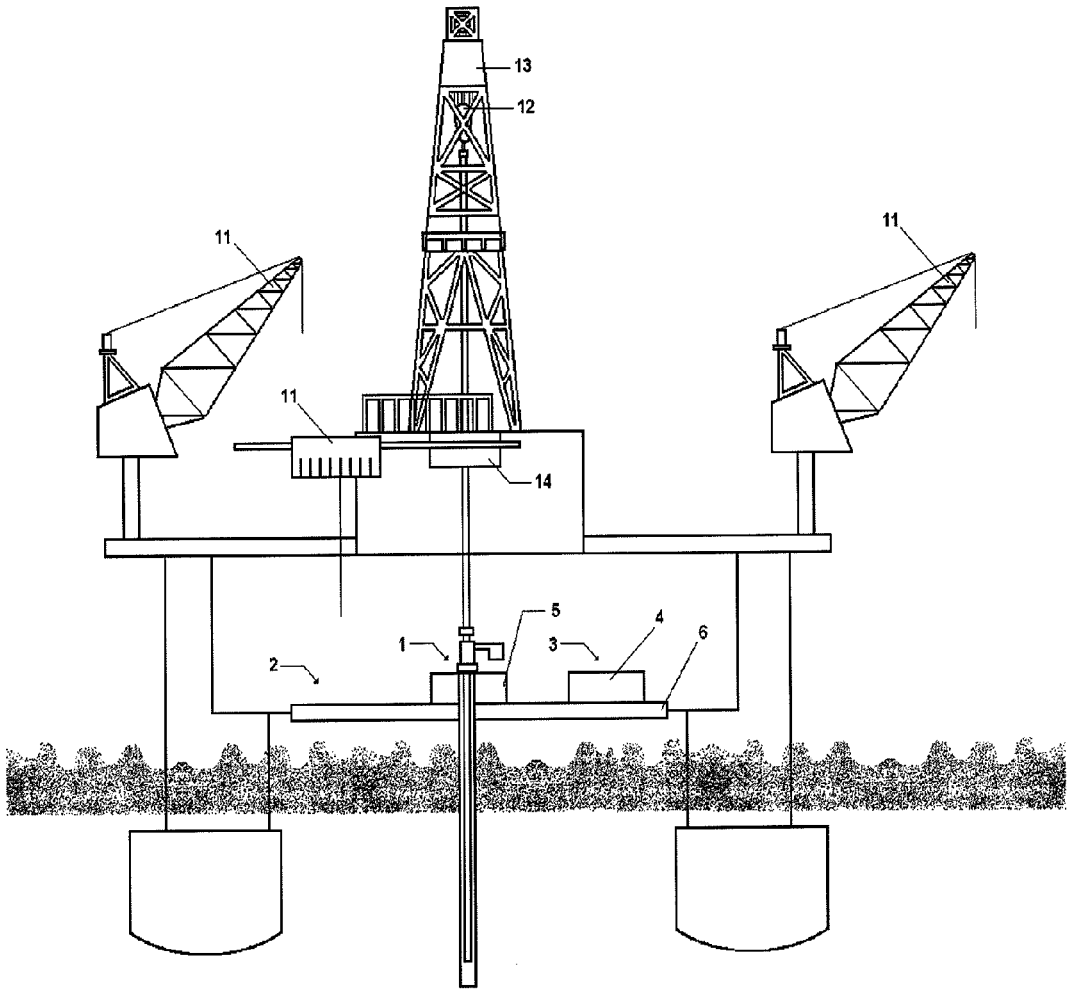
FIG. 4 illustrates the rig of FIG. 1 wherein the first mobile base 4 is moved to an auxiliary operating position 3 and the second mobile base 5 to a first operating position 1.
Figure 5:
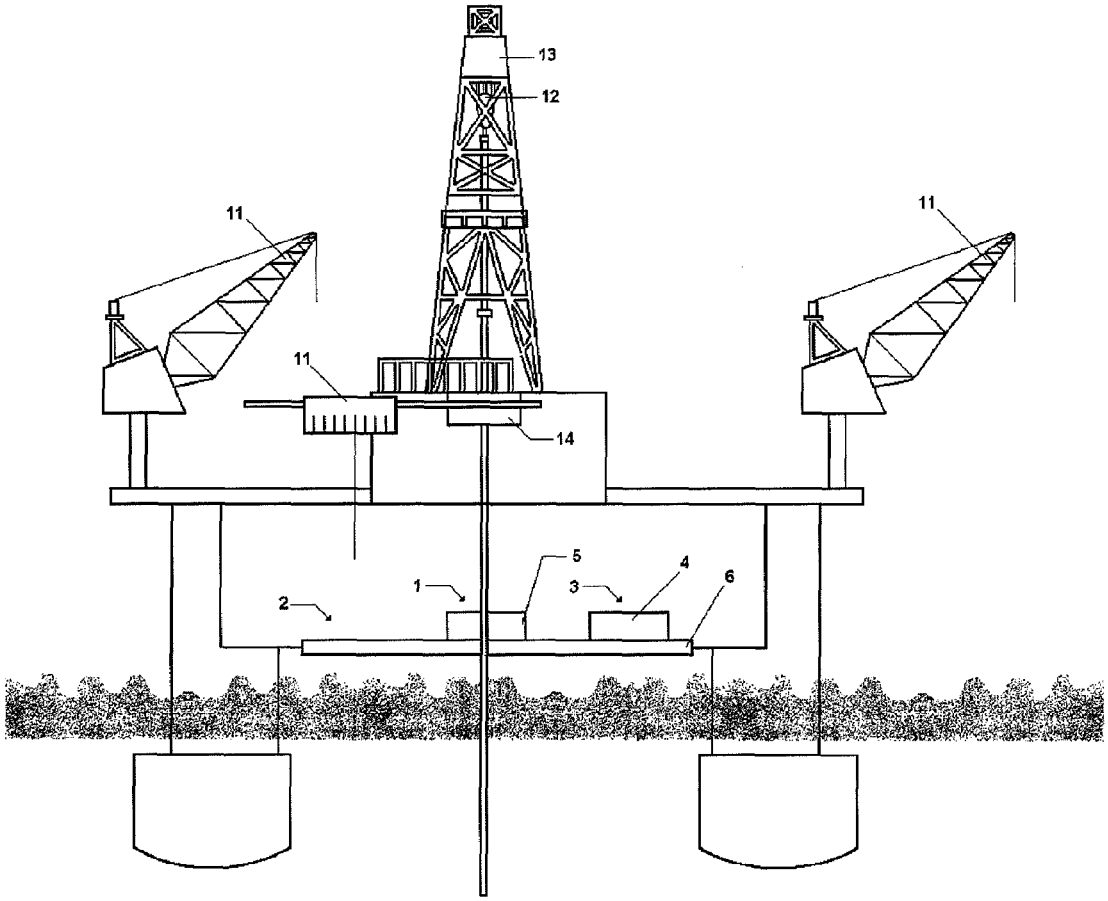
FIG. 5 illustrates the rig of FIG. 1 wherein the rig is installing an item of equipment assembled on the second mobile base 5 on the seabed.

FIGS. 1, 2, 3, 4, and 5 schematically illustrate an exemplary embodiment of a method for simultaneously assembling two items of subsea equipment which are to be installed, which comprises the following steps:

i. Positioning the primary mobile base 4, which is supported on the at least two sustaining beams 6, immediately below the rotary table 14 at a first operating position 1 (as shown in FIG. 1);

ii. Positioning the second mobile base 5, which is supported on the at least two sustaining beams 6, at a second operating position 2 which is horizontally separated from the first operating position 1 (as shown in FIG. 1);

iii. Simultaneously assembling an item of subsea equipment on the first mobile base 4 with the help of the derrick 13, the rotary table 14, and the drawworks 12, and assembling the other item of subsea equipment on the second mobile base 5 with the help of the tools 11 that are available on the rig, such as, for example, cranes, rolling cranes, hoists, winches, mechanical jacks, and other tools usually available on a drilling rig (as shown in FIG. 2);

iv. Lowering and installing the equipment assembled on the first mobile base 4, with the help of the derrick 13, the drawworks 12, and the rotary table 14, using a pipe string (as shown in FIG. 3);

v. Moving the first mobile base 4 away from the second operating position 2 to an auxiliary operating position 3 which is horizontally separated from the first operating position 1 (as shown in FIG. 4);

vi. Moving the second mobile base 5 to the first operating position 1 (as shown in FIG. 4); and vii. Lowering and installing the equipment assembled on the second mobile base 5, with the help of the derrick 13, the drawworks 12, and the rotary table 14, using a pipe string (as shown in FIG. 5).

A person of ordinary skill in the art will readily recognize that the above method can be performed in the sequential order described above and as shown in FIGS. 1-5 or can be performed in a different order. For example, the second mobile base 5 may be positioned in the first operating position 1 first while the first mobile base 4 is positioned in the auxiliary operating position 3, and the equipment assembled on the second mobile base 5 may be lowered and installed before the equipment assembled on the first mobile base 4.

Figure 6:
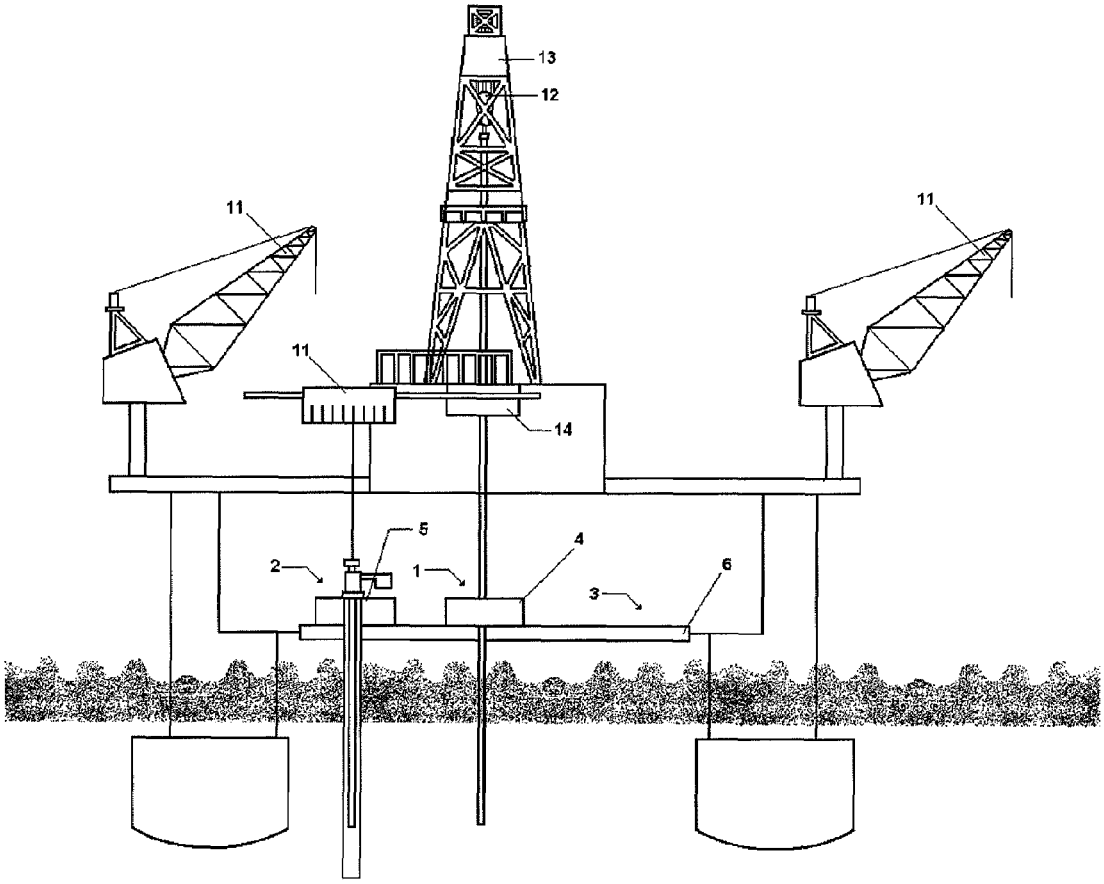
FIG. 6 illustrates the rig of FIG. 1 wherein the rig is raising an item of equipment while simultaneously assembling new equipment on the second mobile base 4.
Figure 7:
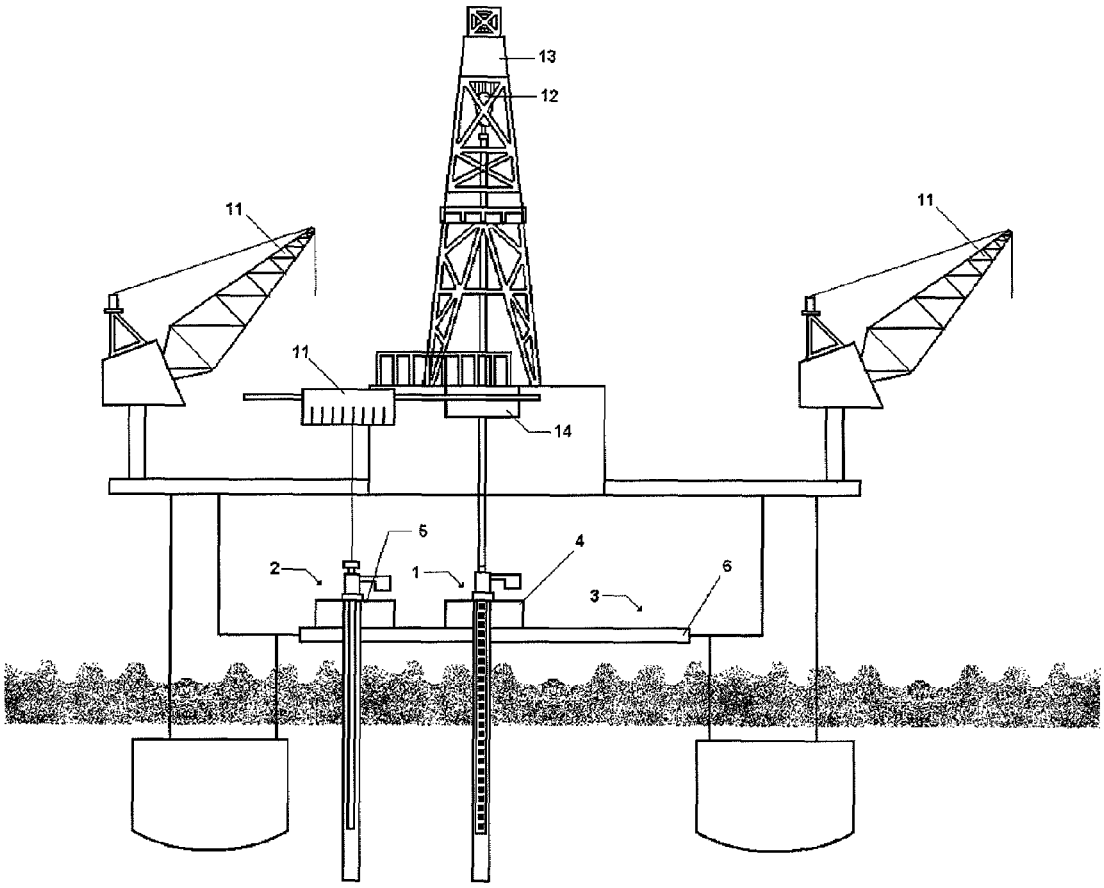
FIG. 7 illustrates the rig of FIG. 1 wherein an item of equipment is supported on the first mobile base 4 while the assembly of other equipment is being simultaneously performed on the second mobile base 5.
Figure 8:
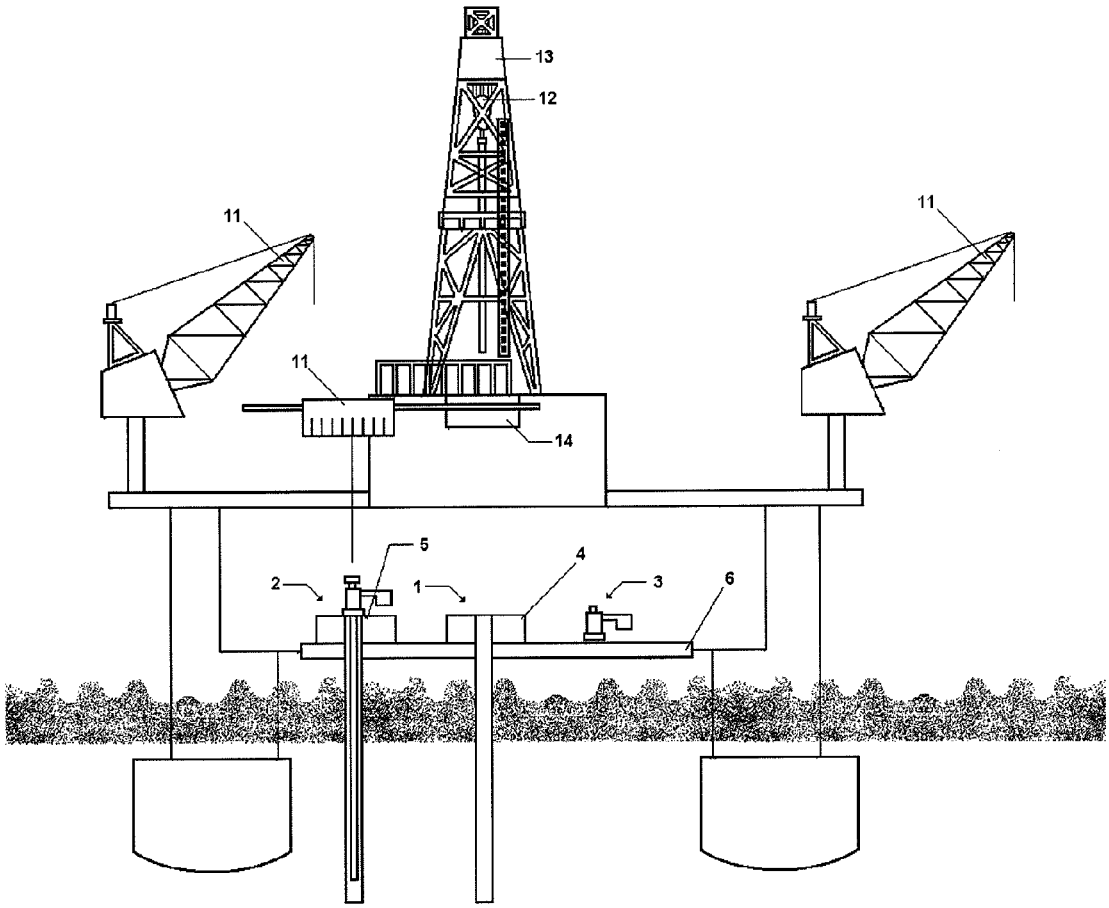
FIG. 8 illustrates the rig of FIG. 1 wherein an item of equipment is dismantled on the first mobile base 4.
Figure 9:
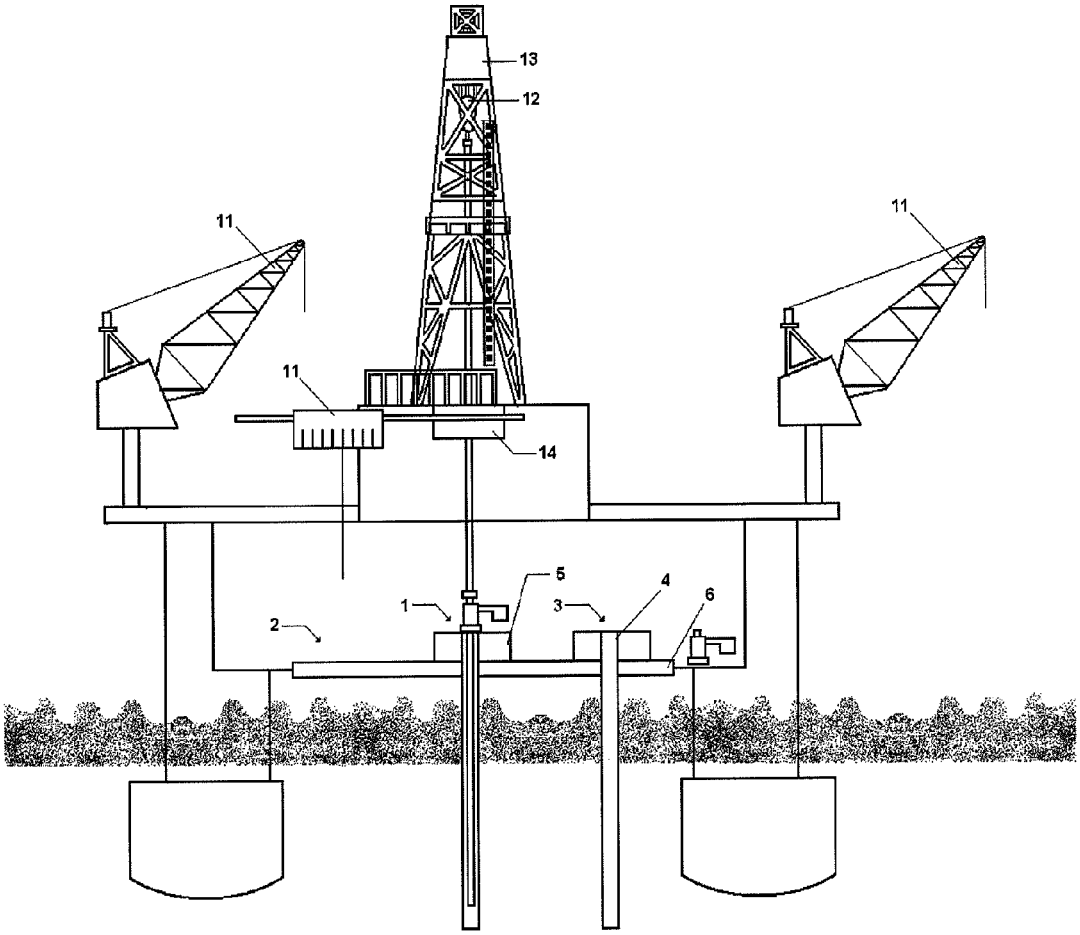
FIG. 9 illustrates the rig of FIG. 1 wherein the first mobile base 4 is moved to the auxiliary operating position 3 and the second mobile base 5 is moved to a first operating position 1.
Figure 10:
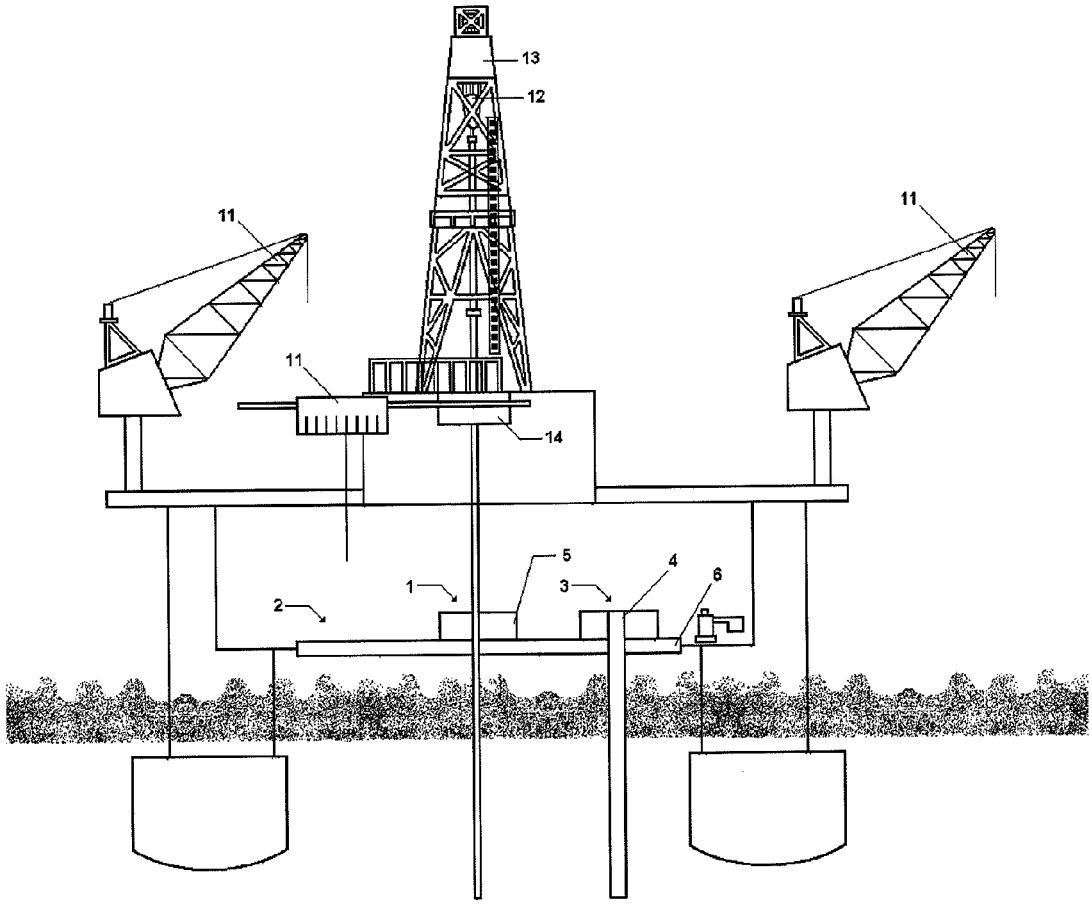
FIG. 10 illustrates the rig of FIG. 1 wherein the rig is lowering and installing new equipment that is mounted on the second mobile base 5 to the seabed.

FIGS. 1, 6, 7, 8, 9, and 10 schematically illustrate an exemplary embodiment of a method for simultaneously replacing and assembling subsea equipment using the system described above, which comprises the following steps:

i. Positioning the first mobile base 4, which is supported on the at least two sustaining beams 6, immediately below the rotary table 14 at a first operating position 1 (as shown in FIG. 1);

ii. Positioning the second mobile base 5, which is supported on the at least two sustaining beams 6, at a second operating position 2 which is horizontally separated from the first operating position 1 (as shown in FIGS. 1 and 6);

iii. Raising an item of subsea equipment up to the first mobile base 4 with the help of a pipe string in order to dismantle the equipment (as shown in FIG. 7);

iv. Dismantling the equipment on the first mobile base 4, with the help of the drawworks 12, the derrick 13, and the rotary table 14, and simultaneously assembling an item of subsea equipment on the second mobile base 5 (as shown in FIGS. 7 and 8);

v. Horizontally moving the first mobile base 4 to the auxiliary operating position 3 and moving the second mobile base 5 to the first operating position 1 (as shown in FIG. 9); and vi. Lowering and installing the equipment assembled on the second mobile base 5, with the help of the derrick 13, the drawworks 12, and the rotary table 14, using a pipe string (as shown in FIG. 10).

A person of ordinary skill in the art will readily recognize that the above method can be performed in the sequential order described above and as shown in FIGS. 1 and 6-10 or can be performed in a different order. For example, the second mobile base 5 may be positioned in the first operating position 1 first while the first mobile base 4 is positioned in the auxiliary operating position 3, and the item of subsea equipment may be raised up to the second mobile base 5 while equipment is being assembled on the first mobile base 4.

Figure 11:
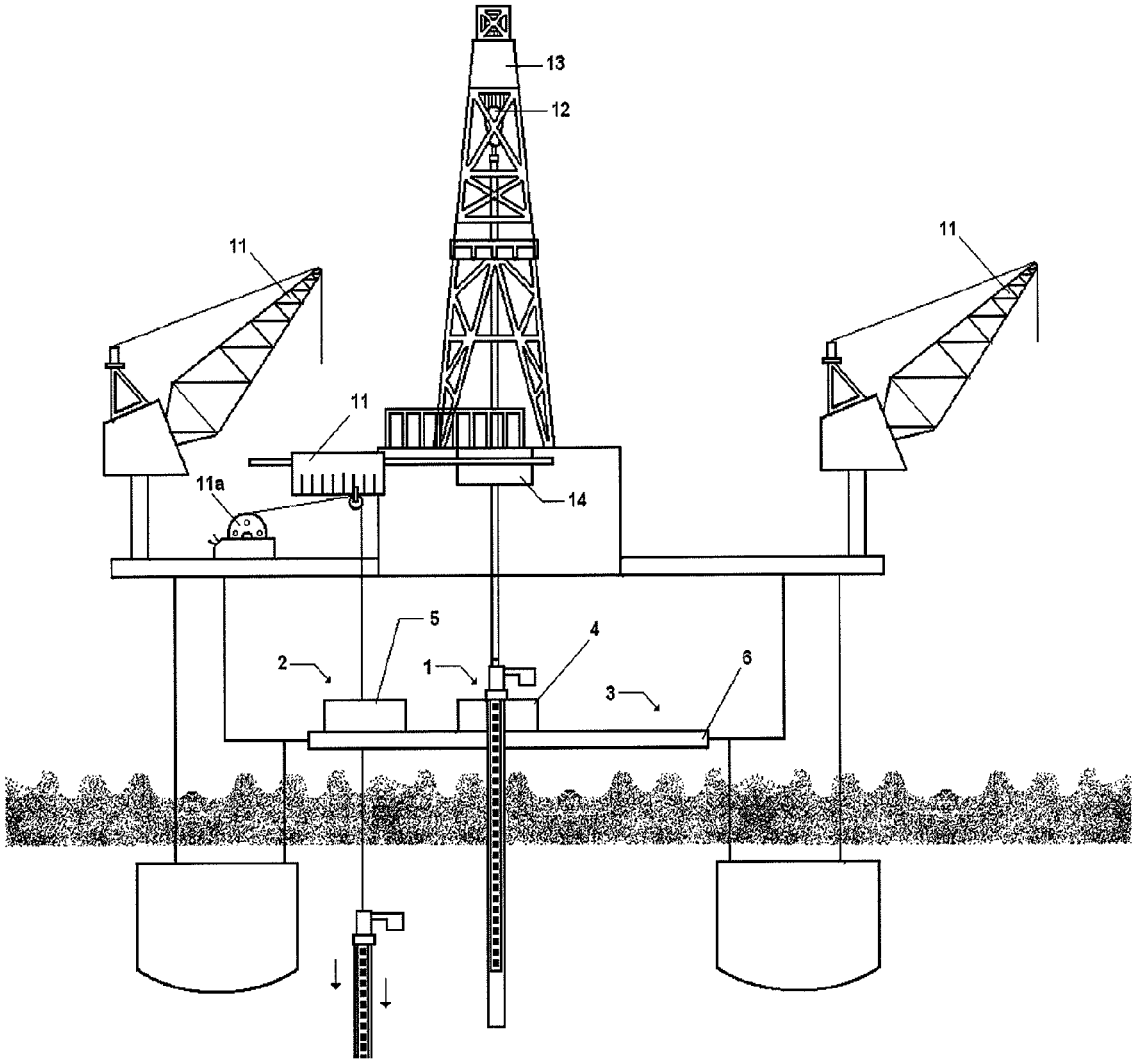
FIG. 11 illustrates an exemplary embodiment of a rig which is lowering an item of equipment that is mounted on the second mobile base 5 to the seabed using a winch 11*a* and a steel cable.

FIG. 11 schematically illustrates an exemplary embodiment of an alternative method where an item of equipment supported on the second mobile base 5 is lowered or recovered by a winch 11*a*, using a steel cable that has a length approximately equal to or greater than the depth of the seabed. Also, while not shown, a winch 11*a* may also be used to lower or recover equipment on the first mobile base 4. A winch 11*a* allows for equipment to be lowered or recovered from the first mobile base 4 and the second mobile base 5 even when the first mobile base 4 and the second mobile base 5 are in the auxiliary operating position 3 or the second operating position 2, respectively.

Using a winch takes less time and is less costly. The equipment that can be lowered or recovered by a winch and steel cable include, but are not limited to, the wet Christmas tree cap, the pumping module, the test cap, the corrosion cap, the well abandonment cap, the control module, recoverable modules in general, and rig positioning system beacons.

Although it is not shown in FIG. 11, the winch 11*a* can be positioned at one of the extremities of the rig and assemble subsea equipment using structures of the "veranda" type, as described in Brazilian Patent Application PI 0702808-3 by the same applicant. The entire disclosure of PI 0702808-3 is hereby incorporated by reference.

Some items of equipment may be moved by a winch and steel cable, instead of using a pipe string, both in the simultaneous installation of two items of subsea equipment and in the simultaneous replacement and assembly of subsea equipment which can significantly reduce the time needed to perform these operations.

The present invention presents significant advantages in relation to the state of the art, because it makes possible:

i. Substantial reduction of the time and cost needed for assembling, dismantling, and maintaining equipment installed by an oil rig, which results in a shorter amount of time necessary to operate the oil rig;

ii. Increase in the rig's operational productivity, by making it possible to carry out certain operations at different operating positions and by using a steel cable operated by a winch;

iii. Increase of the flexibility of the rig's processes and operations;

iv. Increase of the efficiency of the rig's operation, including reducing idle manpower time; and v. Simultaneous performance of operations of lowering, installing, and recovering items of equipment using both a pipe string and a steel cable operated by a winch.

While the present invention has been particularly shown and described with reference to exemplary embodiments thereof, it will be understood by those of ordinary skill in the art that various changes in form and details may be made therein without departing form the spirit and scope of the present invention as defined by the following claims.

What is claimed is:

1. A system for simultaneous execution of operations by a drilling rig or completion rig comprising:

at least two sustaining beams which are substantially parallel to and separated from each other, which are substantially parallel to the sea surface, and extend horizontally over an entire length of a moon pool;

a first mobile base which is supported on the at least two sustaining beams and can move horizontally over the at least two sustaining beams with the use of sliding elements; and a second mobile base which is supported on the at least two sustaining beams and can move horizontally on the at least two sustaining beams with the use of sliding elements, wherein the system is configured such that items of subsea equipment can be simultaneously supported on the first and second mobile bases, respectively, while the items of subsea equipment extend below the at least two sustaining beams in a gravitational direction.

2. The system according to claim 1, wherein the sliding elements are of a roller bearing type.

3. The system according to claim 1, further comprising a derrick.

4. A method for simultaneously assembling two items of subsea equipment using the system according to claim 1, comprising:

positioning the first mobile base, which is supported on the at least two sustaining beams, immediately below a rotary table at a first operating position;

positioning the second mobile base, which is supported on the at least two sustaining beams, at a second operating position which is horizontally separated from the first operating position;

simultaneously assembling an item of subsea equipment on the first mobile base with the help of a derrick while assembling subsea equipment on the second mobile base with the help of support tools;

lowering and installing the equipment assembled on the first mobile base with the help of the derrick using a pipe string;

horizontally moving the first mobile base away from the second operating position to an auxiliary operating position which is horizontally separated from the first operating position;

moving the second mobile base to the first operating position; and lowering and installing the equipment assembled on the second mobile base, with the help of the derrick, using a pipe string.

5. A method for replacing and simultaneously assembling subsea equipment using the system according to claim 1, comprising:

positioning the first mobile base, which is supported on the at least two sustaining beams, immediately below the rotary table at a first operating position;

positioning the second mobile base, which is supported on the at least two sustaining beams, at a second operating position which is horizontally separated from the first operating position;

raising an item of subsea equipment up to the first mobile base with the help of a pipe string in order to dismantle the equipment raised;

dismantling the equipment raised to the first mobile base, with the help of a derrick, and simultaneously assembling an item of subsea equipment on the second mobile base;

horizontally moving the first mobile base to an auxiliary operating position and moving the second mobile base to the first operating position; and lowering and installing the equipment assembled on the second mobile base, with the help of the derrick, using a pipe string.

6. A method for simultaneously assembling two items of subsea equipment using the system according to claim 1, comprising:

positioning the first mobile base, which is supported on the at least two sustaining beams, immediately below a rotary table at a first operating position;

positioning the second mobile base, which is supported on the at least two sustaining beams, at a second operating position which is horizontally separated from the first operating position;

simultaneously assembling an item of subsea equipment on the first mobile base with the help of a derrick while assembling subsea equipment on the second mobile base with the help of support tools;

lowering and installing the equipment assembled on the first mobile base with the help of the derrick using a pipe string; and lowering and installing the equipment assembled on the second mobile base with the help of a winch.

7. A method for replacing and simultaneously assembling subsea equipment using the system according to claim 1, comprising:

positioning the first mobile base, which is supported on the at least two sustaining beams, immediately below the rotary table at a first operating position;

positioning the second mobile base, which is supported on the at least two sustaining beams, at a second operating position which is horizontally separated from the first operating position;

raising an item of subsea equipment up to the first mobile base with the help of a pipe string in order to dismantle the equipment raised;

dismantling the equipment raised to the first mobile base, with the help of a derrick, and simultaneously assembling an item of subsea equipment on the second mobile base; and lowering and installing the equipment assembled on the second mobile base with the help of a winch.

8. The system according to claim 1, wherein the items of subsea equipment are capable of reaching a body of water on which the drilling rig or completion rig is provided on while being supported on the first and second mobile bases, respectively.

9. The system according to claim 3, wherein the at least two sustaining beams are provided below a deck on which the derrick is provided.

10. A system for simultaneous execution of operations by a drilling rig or completion rig comprising:

at least two sustaining beams which are substantially parallel to and separated from each other, which are substantially parallel to the sea surface;

a first mobile base which is supported on the at least two sustaining beams and can move horizontally over the at least two sustaining beams with the use of sliding elements; and a second mobile base which is supported on the at least two sustaining beams and can move horizontally on the at least two sustaining beams with the use of sliding elements, wherein the system is configured such that items of subsea equipment can be simultaneously supported on the first and second mobile bases, respectively, while the items of subsea equipment extend below the at least two sustaining beams in a gravitational direction.

11. The system according to claim 10, wherein the items of subsea equipment are capable of reaching a body of water on which the drilling rig or completion rig is provided on while being supported on the first and second mobile bases, respectively.

12. The system according to claim 10, further comprising a derrick which is provided on a deck, wherein the at least two sustaining beams are provided below the deck on which the derrick is provided.

* * * * *